US005537842A

United States Patent [19]

Battista

[11] Patent Number: 5,537,842

[45] Date of Patent: Jul. 23, 1996

[54] ADJUSTABLE SUPPORT FOR AN EAR COVERING ORNAMENT

[76] Inventor: Natalie Battista, 1539 Grandview Ave., Pittsburgh, Pa. 15211

[21] Appl. No.: 515,364

[22] Filed: Aug. 15, 1995

[51] Int. Cl.[6] ..... A44C 7/00

[52] U.S. Cl. ..... 63/12; 63/14.3; 63/14.4; 63/14.7

[58] Field of Search ..... 63/12, 14.1, 14.2, 63/14.3, 14.4, 14.7, 14.8

[56] References Cited

U.S. PATENT DOCUMENTS

| | | | |
|---|---|---|---|
| 2,502,386 | 3/1950 | Mailand | 63/12 |
| 2,526,087 | 10/1950 | Schoolman et al. | 63/12 |
| 3,630,048 | 12/1971 | Masters | 63/12 |
| 4,829,789 | 5/1989 | Tsamas | 63/14.3 |
| 4,993,240 | 2/1991 | Pounder | 63/12 |
| 5,052,194 | 10/1991 | Jarus | 63/14.3 |
| 5,170,644 | 12/1992 | Calabro | 63/14.4 |
| 5,181,397 | 1/1993 | Battista | 63/12 |

*Primary Examiner*—Kenneth J. Dorner
*Assistant Examiner*—Kien T. Nguyen
*Attorney, Agent, or Firm*—H. Jay Spiegel

[57] ABSTRACT

An adjustable support includes a flat elongated body having an integral hook portion extending away from the plane in which the body lies. The body has an elongated slot sized to receive a fitting carrying a clip member, which fitting may be slidably adjusted within the slot. An enlarged backing member is attached to the body and includes an enlarged surface facing away from the body and designed to receive an ear covering ornament. The hook portion is placed over the top of the ear with the fitting supporting the clip being adjusted for the particular size of the particular ear of the user. The clip is clipped to the earlobe of the ear to retain the body on the ear with an ornament fixed to the backing member covering the ear.

12 Claims, 2 Drawing Sheets

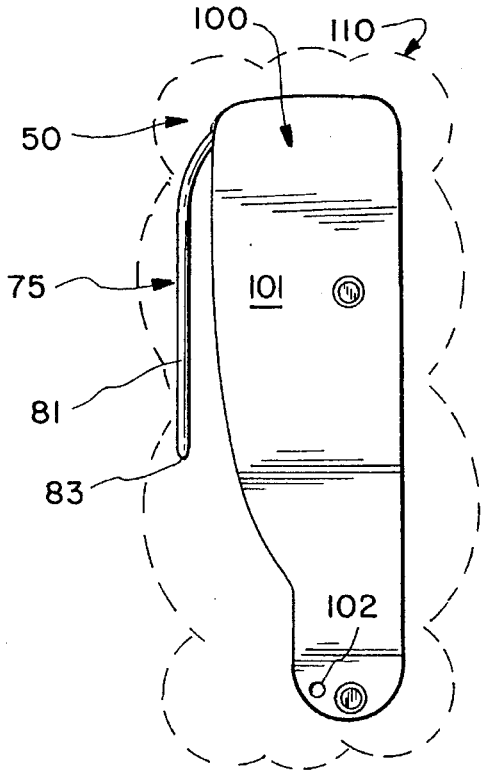
FIG. 3
FIG. 4
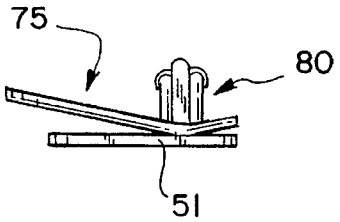
FIG. 5
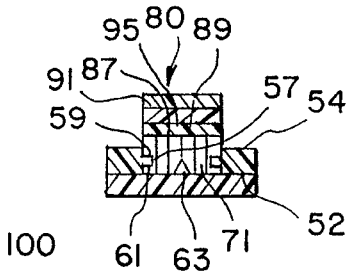
FIG. 6
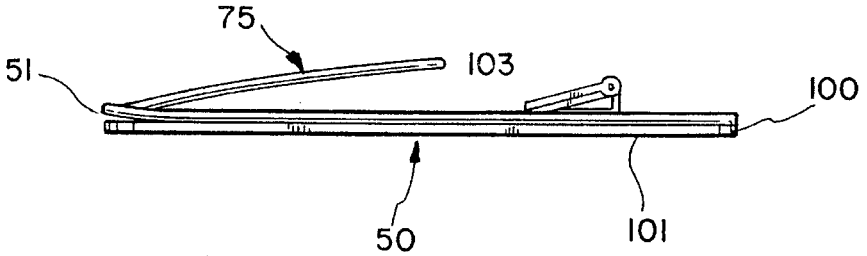

ADJUSTABLE SUPPORT FOR AN EAR COVERING ORNAMENT

BACKGROUND OF THE INVENTION

The present invention comprises improvements over Applicant's prior U.S. Pat. No. 5,181,397. FIG. 1 herein reproduces FIG. 1 from Applicant's prior patent. As shown in FIG. 1, the prior invention is generally designated by the reference numeral 10 and is seen to include a body 11 consisting of an elongated strip 13 of generally rigid materials such as plastic or metal. A first elongated slot 15 is provided in the strip 13 and slidably receives a fitting 17 which pivotably carries the hook 20 which includes one end 21 received within an opening 18 in the fitting 17, a right angle bend 23, a further right angle bend 25 and a curved termination 27 having a distal end 29.

The fitting 17 has a narrowed neck portion which is slidably received within the slot 15, an enlarged bottom portion fitting beneath the slot and a bulbous head portion 35 having the opening 18 therein and receiving the hook 20.

A further slot 37 is provided in the strip 13 and slidably receives a fitting which holds clip assembly 40 in place. The clip assembly 40 includes a pivotable clip member 43 which has outwardly extending pivot members which extend through openings in a base member. In the position of the clip assembly as illustrated in FIG. 1, the clip member 43 may be clipped about the earlobe of the user. The clip fitting may slide within the slot 37 to adjust the particular position of the clip assembly 40 and also permits rotation of the fitting with respect to the slot 37 with frictional interaction holding the clip assembly 40 in any desired rotative orientation.

In the preferred mode of operation of the inventive device 10, the hook-like member 20 may be placed over the top of the portion of the ear which connects to the head of the user with the clip assembly 40 being clipped to the user s earlobe. The various adjustments which are possible due to the rotative interconnection between the hook-like member 20 and the fitting 17 as well as the slot 15 in which the fitting 17 rides, along with the rotative and reciprocatory adjustability of the position and orientation of the clip assembly 40, gives the inventive device great versatility and makes it adaptable to ears of differing sizes and configurations.

While the invention described in Applicant's prior patent has advantageous features, Applicant found that it has deficiencies as well. First, the surface area of the strip 13 of Applicant's prior invention does not have sufficient surface area to facilitate firm permanent attachment of ear ornamentation. Applicant found that ear ornamentation affixed to the rear surface of the strip 13 would eventually fall off. Furthermore, Applicant found that providing the hook and the clip with separate longitudinal adjustments render the subject invention too cumbersome, complicated and expensive. Applicant found that the position of the slot 15 of the prior invention did not permit the hook 20 thereof to extend upwardly a sufficient distance to properly position the ear ornamentation with respect to the ear. In the uppermost position of the hook 20 of Applicant's prior invention, the ear ornamentation rested too high with respect to the location of the ear.

Furthermore, Applicant found that the slots employed to provide longitudinal adjustability to the hook portion and the clip did not permit locking the longitudinal position of the hook portion and clip. As a result, the fittings for the hook portion and clip tended to move after the inventive device 10 was placed on the user's ear. Accordingly, Applicant had to significantly modify the invention described in Applicant's prior patent to arrive at the teachings of the present invention.

Over and above Applicant's prior patent, Applicant is aware of the following patents:

U.S. Pat. No. 2,502,386 to Mailand discloses an earring having a lower clip, a curved wire terminating in a hook-like wire back member and an ornament covering the wire. The present invention differs from the teachings of Mailand as contemplating an elongated body having an integral hook portion, a longitudinally adjustable clip on the body and an enlarged backing member to which an ear ornament may be affixed.

U.S. Pat. No. 2,526,087 to Schoolman et al. discloses an article of jewelry having a lower clip attached to a plate-like body having an upper hook and with an ornament attached thereto. The present invention differs from the teachings of Schoolman et al. as contemplating a longitudinally adjustable clip mounted on an elongated body having an enlarged backing member to which an ear ornament is attached.

U.S. Pat. No. 3,630,048 to Masters teaches an earring having a vertically adjustable lobe contacting member. The present invention differs from the teachings of Masters as contemplating an elongated body having a longitudinally adjustable clip member thereon along with an integrally formed hook portion.

U.S. Pat. No. 4,829,789 to Tsamas discloses a variable pressure earring clasp having a longitudinally adjustable clasp member. The present invention differs from the teachings of Tsamas as contemplating an elongated body having a longitudinally adjustable clip thereon and an enlarged backing member to which an ear ornament may be affixed as well as a hook integrally formed with the elongated body.

U.S. Pat. No. 5,052,194 to Jarus discloses an ear hider having an ornament attached to a plate to which is affixed ear attaching structure. The present invention differs from the teachings of Jarus as contemplating an elongated body having a longitudinally adjustable clip attached thereto along with an integral hook with the device including the further provision of an enlarged adapter to which an ear ornament may be affixed.

SUMMARY OF THE INVENTION

The present invention relates to an adjustable support for an ear covering ornament which may be employed for either ear. The present invention includes the following interrelated objects, aspects and features:

(A) In a first aspect, the present invention includes an elongated body having a first end and a second end. An elongated slot extends from the first end toward the second end and is sized to receive a fitting to which is attached a clip member. The elongated slot is defined by recesses extending inwardly from opposed faces of the elongated body with each recess receiving a portion of the fitting. The elongated slot has a series of relieved portions at spaced locations therealong which are designed to receive surfaces of the fitting to retain the clip member at any one of a multiplicity of discrete spaced locations along the length of the elongated slot.

(B) The second end of the elongated body has integrally formed therewith and extending therefrom a hook member. The elongated body lies in a single plane and the hook member curves away from the plane as will be described in greater detail hereinafter.

(C) On a face of the elongated body remote from the direction of curvature of the hook member, an enlarged plate is affixed to the elongated body. The enlarged plate overlies the elongated slot of the elongated body and extends laterally outwardly away from the elongated body. On a face of the enlarged plate remote from the elongated body, an enlarged surface is provided which allows fixation of an ornament thereto.

Accordingly, it is a first object of the present invention to provide an adjustable support for an ear covering ornament.

It is a further object of the present invention to provide such a device including an elongated body having an elongated recess therein.

It is a yet further object of the present invention to provide such a device wherein a clip member has a fitting which is slidably received within the elongated slot.

It is a still further object of the present invention to provide such a device wherein the elongated body has an integral hook member.

It is a yet further object of the present invention to provide such a device including an enlarged plate fixed to the elongated body and designed to have an ear covering ornament affixed thereto.

These and other objects, aspects and features of the present invention will be better understood from the following detailed description of the preferred embodiment when read in conjunction with the appended drawing figures.

BRIEF DESCRIPTION OF THE DRAWINGS

FIG. 3 shows a front view of the present invention.

FIG. 4 shows an end view of the present invention.

FIG. 5 shows a cross-sectional view along the line V—V of FIG. 2.

FIG. 6 shows a side view of the present invention.

SPECIFIC DESCRIPTION OF THE PREFERRED EMBODIMENT

Figure 1:
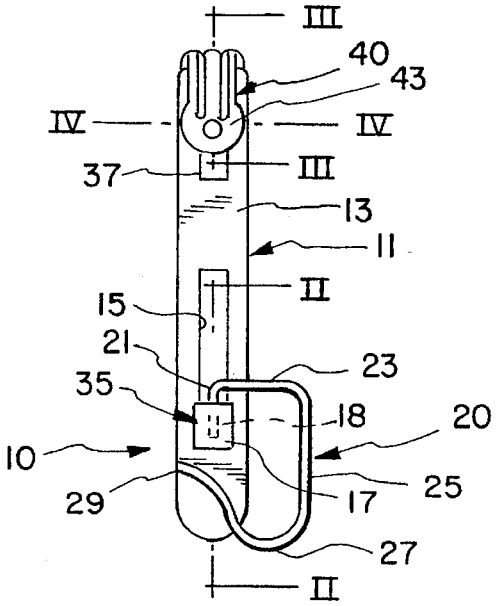
FIG. 1 PRIOR ART
FIG. 1 shows a rear view of a prior art substitute for pierced earrings as disclosed in Applicant's prior U.S. Pat. No. 5,181,392.

With reference to FIGS. 2–6, the present invention is generally designated by the reference numeral 50 and is seen to include an elongated body 51 having a first end 53 and a second end 55. Extending from the first end 53 toward the second end 55 is an elongated slot 57.

Figure 2:
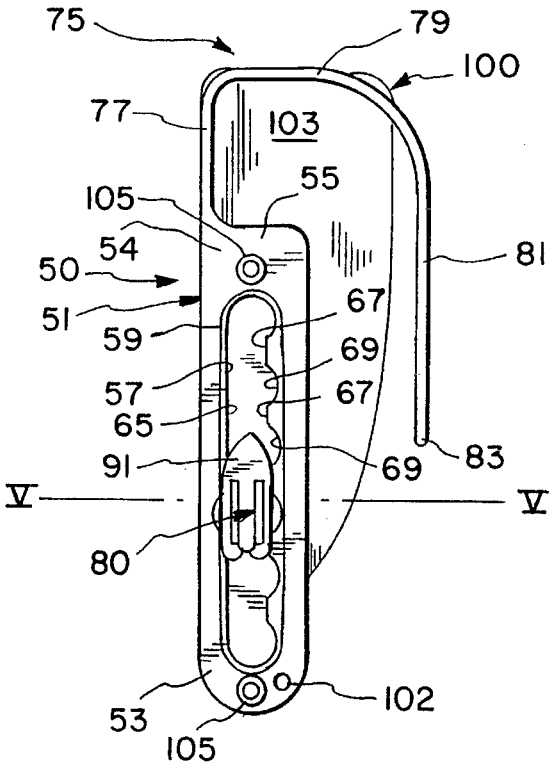
FIG. 2 shows a rear view of the present invention.

The elongated body 51 includes a front surface 52 and a rear surface 54. As seen in FIGS. 2 and 5, the rear surface 54 includes a rearward relieved portion 59 defining a rearward edge of the slot 57 and the front surface 52 includes a forward relieved portion 61 which defines the forward extent of the slot 57. With further reference to FIG. 5, a fitting 63 is designed to ride in the slot 57 as well as within the relieved portions 59 and 61 adjacent thereto. The fitting may comprise a large rivet. The slot 57 includes an elongated straight wall 65 and an opposed wall including straight portions 67 separated by outwardly arcuate portions 69. The fitting 63 has a central portion 71 which engages the walls 65, 67 and 69 of the slot 57, a top portion engaging the forward relieved portion 61 and a bottom portion engaging the rearward relieved portion 59. When the portion 71 of the fitting 63 engages the wall portions 69 of the slot 57, the fitting 63 is retained in fixed position at those locations. In order to move the fitting 63 from such a position, the inherent resiliency of the body 51 allows forcing of the fitting 63 from a wall portion 69 into a wall portion 67 and then into the next wall portion 69 where the fitting 63 may be retained. The portions 69 act as recesses for the detent-like portion 71 of the fitting 63 to allow locking of the position of the fitting 63 at a multiplicity of discrete locations along the slot 57.

Integrally extending from the second end 55 of the elongated body 51 is a hook member 75 which includes a first portion 77 which is elongated generally along the same direction of elongation as the elongated body 51, a second portion 79 which extends laterally across the width of the elongated body 51 and a third portion 81 which extends generally parallel to the direction of elongation of the body 51 and terminates in an end 83. As best seen with reference to FIGS. 4 and 6, the elongated body 51 extends in generally a single plane. The hook member 75 departs from this plane and extends downwardly with respect to the rear face 54 of the body 51. In this way, the hook member 75 may easily be placed over the connecting point between the head of the user and the ear thereof.

The body 51 may include a hole 102 sized to receive the wire (not shown) of a pierced earring. A similar hole may be provided in the ornament 110 for the same purpose.

With reference back to FIGS. 2 and 5, a clip member 80 is attached to the fitting 63. As best seen in FIG. 5, the fitting 63 has a top surface 87 on which a pad 89 is placed. The clip member 80 has a pivoting member 91 having an undersurface on which a pad 95 is fixed. The pads 89 and 95 are intended to grip opposed faces of the earlobe of the user so that, in conjunction with the hook member 75, the inventive device 50 may be releasably mounted on the ear of the user.

A plate member 100 has a front surface 101 and a rear surface 103. As best seen in FIG. 2, the plate member 100 is attached to the body 51 in any suitable manner such as, for example, through the use of rivets 105. The front surface 101 of the plate member 100 is highly enlarged as compared to the front surface 52 of the elongated body 51. The enlarged surface 101 of the plate member 100, which is best seen in FIG. 3, is designed to have attached thereto an ear ornament such as that which is shown in phantom in FIG. 3. The enlarged surface 101 enhances adherence of the ornament 110 thereon. Suitable adhesive may be employed to affix the ornament 110 to the surface 101. Of course, other fastening means may be employed such as, for example, hook and pile fastening means, snaps, etc.

In the preferred embodiment of the present invention, the elongated body 51, with its integrally formed hook member 75, is made of a resilient plastic material. It is preferred that the plate member 100 also be made of plastic but, of course, the plate member 100 may be made of any suitable material such as wood or metal so long as it is able to receive an adhering ear ornament 110. In the preferred embodiment, as seen in FIG. 6, the body 51 and plate member 100 are curved to generally conform with the natural curvature of a human head.

The adjustable support illustrated in the drawings is for the left ear. Of course, the inventive device is also employed for the right ear and is made, for the right ear, in, essentially, a mirror image of the left ear adjustable support shown, as should be understood by those skilled in the art.

Accordingly, an invention has been disclosed in terms of a preferred embodiment thereof which fulfills each and every one of the objects of the invention as set forth hereinabove and provides a new and useful adjustable support for an ear covering ornament of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. An adjustable support for an ear covering ornament, comprising:

a) an elongated body having a first end and a second end and front and rear faces, said body lying in a plane;

b) a hook integrally formed with said body and extending away from said second end and out of said plane;

c) an elongated slot in said body;

d) a fitting slidably received in said slot and carrying attachment means for attaching said body to an earlobe of an ear of a user with said hook adapted to be draped over the ear, said attachment means extending from said rear face;

e) a plate affixed to said front face, said plate having a front surface larger in area than an area of said front face; and f) an ear covering ornament affixed to said front surface of said plate.

2. The adjustable support of claim 1, wherein said elongated slot extends from adjacent said first end of said body and toward said second end thereof.

3. The adjustable support of claim 1, wherein said elongated slot includes an elongated straight wall and an opposed wall having a plurality of spaced relieved portions, each relieved portion being sized to receive said fitting therein, whereby said fitting may be releasably retained at discrete spaced locations along said slot.

4. The adjustable support of claim 1, wherein said hook includes a first straight portion extending away from said body second end, a second arcuate portion extending away from said first portion at an acute angle with respect thereto and a third straight portion extending from said second portion and adjacent said body but spaced from said plane rearward of said rear face with respect to said front face.

5. The adjustable support of claim 1, wherein said attachment means comprises a clip.

6. The adjustable support of claim 1, wherein said body includes relieved portions forward and rearward of said slot, said fitting including a central portion engaging said slot and top and bottom portions engaging, respectively, said forward and rearward relieved portions.

7. The adjustable support of claim 1, wherein said ornament or body has a hole therein sized to receive a wire for a pierced earring.

8. The adjustable support of claim 1, wherein said body including said integral hook is made of plastic.

9. The adjustable support of claim 1, wherein said fitting is made of metal.

10. The adjustable support of claim 1, wherein said ear covering ornament is attached to said plate with adhesive.

11. The adjustable support of claim 1, wherein said body is attached to said plate with rivets.

12. The adjustable support of claim 1, wherein said elongated body and plate are arcuately curved to generally conform with a curvature of a human head.

* * * * *